US007435519B2

(12) United States Patent
Yaguchi et al.

(10) Patent No.: US 7,435,519 B2
(45) Date of Patent: Oct. 14, 2008

(54) ELECTROPHOTOGRAPHIC TONER AND IMAGE FORMING APPARATUS

(75) Inventors: Shigenori Yaguchi, Hitachinaka (JP); Junji Kobayashi, Hitachinaka (JP); Tomonari Hokkyo, Hitachinaka (JP); Hirobumi Ouchi, Mito (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 366 days.

(21) Appl. No.: 11/030,970

(22) Filed: Jan. 10, 2005

(65) Prior Publication Data

US 2005/0164110 A1 Jul. 28, 2005

(30) Foreign Application Priority Data

Jan. 27, 2004 (JP) ..... 2004-018062

(51) Int. Cl.
*G03G 9/087* (2006.01)
*G03G 9/097* (2006.01)

(52) U.S. Cl. ..... 430/108.4; 430/109.4

(58) Field of Classification Search ..... 430/108.3, 430/108.4, 109.4; 399/252
See application file for complete search history.

(56) References Cited

U.S. PATENT DOCUMENTS

| | | | | |
|---|---|---|---|---|
| 3,787,526 | A | 1/1974 | Burns et al. | |
| 5,923,933 | A * | 7/1999 | Anzai et al. | 399/269 |
| 6,335,139 | B1 * | 1/2002 | Gambayashi et al. | 430/111.4 |
| 2003/0031946 | A1 * | 2/2003 | Sugiura et al. | 430/108.3 |

FOREIGN PATENT DOCUMENTS

| | | |
|---|---|---|
| JP | 52-25420 | 7/1977 |
| JP | 53-17496 | 6/1978 |
| JP | 55-038524 | 3/1980 |
| JP | 62-45552 | 9/1987 |
| JP | 02-048674 | 2/1990 |
| JP | 02-221967 | 9/1990 |
| JP | 05-265257 | * 10/1993 |
| JP | 07-160123 | 6/1995 |
| JP | 10-115947 | 5/1998 |
| JP | 2003-98757 | 4/2003 |
| JP | 2003-122052 | 4/2003 |
| JP | 2003-248340 | 9/2003 |

OTHER PUBLICATIONS

Japanese Patent Office machine-assisted translation of JP 05-265257 (pub. Oct. 1993).*

* cited by examiner

*Primary Examiner*—Janis L Dote
(74) *Attorney, Agent, or Firm*—Antonelli, Terry, Stout & Kraus, LLP.

(57) ABSTRACT

An electrophotographic toner comprising at least a fixing resin, a coloring agent, a release agent and a charge control agent, wherein the release agent is carnauba wax, the charge control agent is a boron complex of a salicylic acid derivative, and the fixing resin contains two kinds of polyester resins in ratio represented by the following equation (1);

$$\frac{A(T_{1/2})-A(T_{fb})}{B(T_{1/2})-B(T_{fb})} \leqq \frac{A(T_{1/2})\times C}{B(T_{1/2})\times D} \leqq \frac{B(T_{1/2})-B(T_{fb})}{A(T_{1/2})-A(T_{fb})}, \quad (1)$$

wherein in the above equation, $A(T_{1/2})-A(T_{fb})<B(T_{1/2})-B(T_{fb})$, $A(T_{1/2})$ represents a softening point (° C.) of the polyester A, $A(T_{fb})$ a flow-out start point (° C.) of the polyester A, $B(T_{1/2})$ a softening point (° C.) of the polyester B, $B(T_{fb})$ a flow-out start point (° C.) of the polyester B, C a weight rate of the polyester A in the fixing resin, and D a weight rate of the polyester B in the fixing resin.

9 Claims, 1 Drawing Sheet

ELECTROPHOTOGRAPHIC TONER AND IMAGE FORMING APPARATUS

CLAIM OF PRIORITY

The present application claims priority from Japanese application serial No. 2004-018062, filed on Jan. 27, 2004, the content of which is hereby incorporated by reference into this application.

FIELD OF THE INVENTION

The present invention relates to an electrophotographic toner for developing an electrostatic latent image formed in an electrophotographic method, an electrostatic printing method, an electrostatic recording method, etc. and also relates to an image forming apparatus using the above-mentioned toner.

RELATED ART

Among the electrophotographic method, the electrostatic printing method, the electrostatic recording method, etc, in the electrophotographic method a photosensitive member is charged and exposed to light to form an electrostatic latent image on the photosensitive member. Then, the electrostatic latent image is developed with a toner of fine powder comprising a resin binder, a coloring agent, etc. The resulting toner image is transferred to a recording medium such as paper.

In the electrophotographic method a fixing step of the toner image on the recording medium and a developing step of the electrostatic latent image are very important steps.

As the progress of color printing, non-magnetic single components color toners that do not contain magnetic carriers are widely used in common or multipurpose color printers. However, in high speed printers a magnet brush developing method which uses two-component toners is most popular.

On the other hand, in a new type of laser beam printers a dot density is as high as 600 to 1200 dpi (dots/inch) by narrowing a beam diameter. As a result, the diameters of the toner and the magnetic toner have been made small; application of a toner of which a volume average particle size is as small as 10 μm or less and a carrier of which a weight average particle size is as small as 100 μm has been made.

However, a yield of the toner of the small particle size is low at the time of grounding and sieving for toner production. In general, a toner having a particle size of less than 4 μm has a difficulty in practical use. Accordingly, the particle size of the toners is limited to 4 to 10 μm, and the particles outside of the particle size are disposed; the fluidity of the toner is improved by adding improved additive agents to the toner and by improved adding methods.

On the other hand, as the small particle size of the toner, the weight average particle size of the magnetic carriers is controlled to 100 μm or less thereby to increase the surface area of the magnetic toner so that the friction chargeability of the magnetic toner with respect to the toner is improved. However, when the weight average particle size of the carrier is less than 30 μm, magnetic force decreases, and it tends to adhere to the charge holding member due to electromagnetic attractive force. Therefore, it is a conventional method that the sieving of the carrier is conducted so that the weight average of the carrier becomes 30 to 100 μM. If necessary, the surface of the carrier is coated with a resin.

As explained above, improvement of particle size distribution, fluidity and chargeability have made possible to put the small particle size toner and carrier into practice. However, when performing printing by actual machines, especially in such a high speed printing as repetition of 50 pages per minute, the life of the developing agent becomes shorter due to spending of carrier by the toner and filming of the photosensitive member takes place.

On the other hand, the improvement of toner characteristics has been desired for the high speed printing. Especially, in a heat role fixing system, enlargement of non-off set area where cold off set and hot off set is needed, and excellent fixing characteristics are desired as well. As a fixing resin for the electrophotographic toner, polystyrene, styrene-acrylate copolymer, styrene-butadiene copolymer, polyester, epoxy resin, etc. have been used.

Polyester resins have been widely used for heat role fixing as disclosed in patent documents No. 1 to 3. However, polyester resins that satisfy requirement of low fixing temperatures and a wide offset area have not been realized yet.

In order to improve release of the toner from the heat role at the time of fixing and to prevent offset, addition of a release agent has been known. As the release agent, a synthetic wax such as polypropylene wax, polyethylene wax, etc and natural was such as carnauba wax, rice wax, etc have been known.

As a charge control agent, nigrosine or azo dye complexes having chromium or iron as a center metal are widely used. Since their charge control capability is high, stable charging property is obtained. However, since these charge control agents are colored, they are not used for color printing. As colorless charge control agents, quarternary ammonium compound for positive charging and metal complexes of salicylic acid derivatives are known. It has been confirmed that some of the metal complexes of salicylic acid derivatives are water dissolvable and have strong toxicity to aquatic life; safer charge control agents are desired.

As the metal complexes of salicylic acid derivative, compounds whose metal ion is boron have been know as disclosed in patent publication No. 4. Although the toxicity of these compounds to aquatic life is not known, the toner that uses the boron complexes of salicylic acid derivatives is weaker in charge control capability than the conventional charge control agents and poorer in chargeability.

In the image forming apparatus using the color toner, an amount of the toner consumed depending on patterns of printing. For example, patterns such as graphics whose printing density is high, a large amount of toner is consumed. Therefore, the toner supplied to the two component developing agent must be charged quickly. On the other hand, in case where an mount of consumed toner is very small, the number of stirring of the toner in the developing device and then silica powder adhered to the surface of the toner particles may be buried in the toner by the mechanical stress of the stirring in the developing device.

Further, when printing is started immediately after a stop of printing such as night time or holidays during that time the image forming apparatus is not operated, the charge of the toner whose charge amount becomes insufficient due to the stop may become instable and image concentration may be changed.

If the amount of charge in the two component developing agent changes, the developing property of the toner changes and increase or decrease in an amount of the toner depositing on the paper may takes place. In case of a color toner, since the tone may change if the depositing amount of the toner on the paper; the change is more distinguishable than black toner. Therefore, it is necessary to control charge amount so as to avoid change of depositing amount of the toner on the paper.

When the above-mentioned boron complexes of salicylic acid derivatives are used as a charge control agent, the amount of charge do not follow the change of printing density to cause the concentration change of image but not to obtain the stable charge characteristics.

(Patent document No. 1): Japanese patent publication Shou 52-25420

(Patent document No. 2): Japanese patent publication Shou 53-17496

(Patent document No. 3): Japanese patent laid-open publication No. Shou 55-38524

(Patent document No. 4): Japanese patent publication Hei 7-13765

SUMMARY OF THE INVENTION

It is an object of the present invention to provide a an electrophotographic toner with a less change of charge, which can maintain an amount of charge even when there is a printing density or at the time of stop of operation of the apparatus and can secure a stable deposit amount of toner on paper. Further, the present invention provides an image forming apparatus using the toner.

The present invention solves the above-mentioned problem by employing a charge control agent that can be fixed at a low temperature, good storage and stability in environment, low burden on environment and high safety.

The electrophotographic toner according to the present invention contains at least a fixing resin, a coloring agent, a release agent and a charge control agent, wherein the release agent is carnauba wax, the releasing agent is a boron complex of salicylic acid derivatives, and the fixing resin comprises two kinds of polyester resins. The polyester resins have the following relationship expressed by equation (1):

Equation(1):

$$\frac{A(T_{1/2})-A(T_{fb})}{B(T_{1/2})-B(T_{fb})} \leqq \frac{A(T_{1/2})\times C}{B(T_{1/2})\times D} \leqq \frac{B(T_{1/2})-B(T_{fb})}{A(T_{1/2})-A(T_{fb})} \quad (1)$$

In the above equation, $A(T_{1/2})-A(T_{fb})<B(T_{1/2})-B(T_{fb})$, wherein $A(T_{1/2})$ represents a softening point (° C.) of the polyester A, $A(T_{fb})$ a flow-out start point (° C.) of the polyester A, $B(T_{1/2})$ a softening point (° C.) of the polyester B, $B(T_{fb})$ a flow-out start point (° C.) of the polyester B, C a weight rate of the polyester A in the fixing resin, and D a weight rate of the polyester B in the fixing resin.

DETAILED DESCRIPTION OF THE PREFERRED EMBODIMENTS

Figure 1:
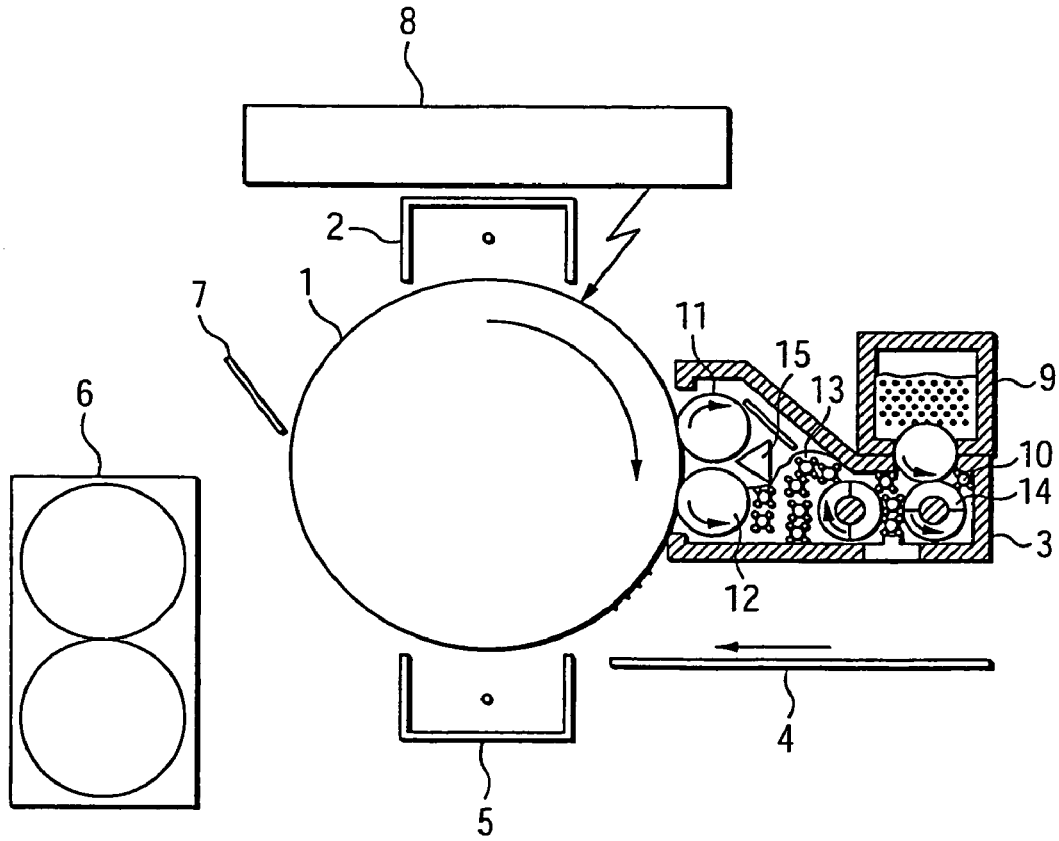
FIG. 1 is a diagrammatic view of an image forming apparatus to which the present invention is applied.

In the electrophotographic toner according to the present invention, an amount of the boron complex of the salicylic acid derivatives is preferably 0.1 to 1 part by weight per 100 parts by weight of the resin. Further, it is preferable to adhere silica fine powder having a primary particle size of 10 nm or less on the surface of the toner. A preferable softening point ($T_{1/2}$) of the toner is 110 to 140° C. By these conditions, it is possible to lessen the concentration change of images.

The image forming apparatus of electrostatic recording type of the present invention develops an electrostatic latent image with a toner, transfers the developed latent image to a recording medium, and fix the transferred image to obtain a recording image, wherein the toner is one mentioned-above.

In the image forming apparatus of the present invention, a developing device for developing the electrostatic latent image is preferably a center feed system, which is provided with a forward rotating role that rotates in the forward direction as does an electrostatic charge retention member and a reverse rotating role that rotates in the reverse direction as does the forward rotating role. In the an image forming apparatus having the developing device of the center feed type, the toner is preferably a two component type developing agent containing an electrophotographic toner and a magnetic carrier. The friction charge amount is preferably within a range of −10 to −20 μm.

According to the present invention, the toner can retain an amount of charge depending on the change of printing density and retain even after the stop of operation so that an amount of the toner deposition on the recording medium with a less change of toner concentration could be obtained. Further, the above advantages could be performed by employing a charge control agent, which is capable of fixed at a low temperature, excellent in environmental stability, and less burdening on environment.

The electrophotographic toner according to the present invention contains at least a fixing resin, a coloring agent, a release agent and a charge control agent. Further, the fixing resin should contain two kinds of polyesters.

Polyester resins include polymers obtained by polycondensation of dicarboxlyic acids and diols. Dicarboxylic acids include maleic acid anhydride, telephtalic acid, isopthalic acid, orthopthalic acid, maleic acid, maleic acid anhydride, adipic acid, fumalic acid, itaconic acid, citraconic acid, succinic acid, malonic acid, glutaric acid, etc and their derivatives and their esters.

Diols include ethylenene gycol, diethylene glycol, propylene glycol, dipropylene glycol, tripropylene glycol, butane diol, pentane diol, hexane diol, bisphenol A, polyoxyethylene-(2,0)-2,2-bis-(4-hydroxyphenyl)propane, its derivatives, polyoxypropylene-(2,0)-2.2-bis(4-hydroxyphenyl)propane, polyoxypropylene-(2,2)-polyoxyethylene-(2,0)-2,2-bis (4 -hydroxyphenyl)propane, polyoxypropylene-(6)-2,2-bis (4-hydroxyphenyl)propane, polyoxypropylene-(2,2)-2,2-bis (4-hydroxyphebyl)propane, polyoxypropylene-(2,4)-2,2-bis (4-hydroxyphebyl)propane, polyoxypropylene-(3,3)-2,2-bis (4-hydroxyphebyl)propane, their derivatives, polyethylene glycol, polypropylene glycol, ethyleneoxide-propyleneoxide randomcopolymer diol, ethyleneoxide-propyleneoxide blockcopolymer diol, ethyleneoxidediol-tetrahydrofrane copolymer diol, polycaprolacton diol, etc.

In addition to the above listed dicarboxylic acids and diols, there are other polyvalent carboxylic acids of three valents or more or their derivatives or polyvalent alcohols of three valents or more. The polyvalent alcohols are subjected to dehydrated-polycondensation. As polyvalent alcohols of three or more valents, there are trimellitic acid, trimellitic acid anhydride, pyromellitic acid, pyromellitic acid anhydride, etc. As polyvalent alcohols of three or more valents, there are sorbitol, 1,2,3,6-hexane tetraol, 1,4-sorbitan, pentaerithritol, 1,2,4-butane triol, 1,2,5-pentane triol, glycerine, 2-methyl propane triol, 2-methyl-1,24-butane triol, trimethylol ethane, 1,3,5-trimethylol benzene, etc.

Fixability of electrophotographic toner is an important evaluation item for an image forming apparatus. Especially, in high speed image forming apparatuses the weight of the fixability is significant.

In the conventional color printers color development has been viewed seriously. As a result, a method where toner is sufficiently melted has been employed widely. In this method, since hot offset happens, a lot of silicone oil is coated on a fixing role thereby to secure ability to release from the role to prevent the hot offset. Paper that has passed through a fixing device where a lot of silicone oil is coated has difficulty in correction, and since the paper has a greatly changed friction coefficient, transfer of the paper has difficulty so that jam happens in the image forming apparatus frequently when the paper is used again. Therefore, the amount of silicone oil used for fixing should be as small as possible. Upon investigation of the fixability and offset, is has been revealed that when a difference between a flow-out stat temperature ($T_{fb}$) and a softening temperature ($T_{1/2}$) of a polyester resin and a ratio of the two kinds of polyesters satisfy the equation (1), a high fixing speed was realized and the offset cloud be prevented.

$$\frac{A(T_{1/2})-A(T_{fb})}{B(T_{1/2})-B(T_{fb})} \leqq \frac{A(T_{1/2})\times C}{B(T_{1/2})\times D} \leqq \frac{B(T_{1/2})-B(T_{fb})}{A(T_{1/2})-A(T_{fb})} \quad (1)$$

In the above equation, $A(T_{1/2})-A(T_{fb})<B(T_{1/2})-B(T_{fb})$, wherein $A(T_{1/2})$ represents a softening point (° C.) of the polyester A, $A(T_{fb})$ a flow-out start point (° C.) of the polyester A, $B(T_{1/2})$ a softening point (° C.) of the polyester B, $B(T_{fb})$ a flow-out start point (° C.) of the polyester B, C a weight rate of the polyester A in the fixing resin, and D a weight rate of the polyester B in the fixing resin.

When two kinds of polyesters are used in such a manner that the above condition represented by the equation (1), the hot offset or decrease in fixing strength tend to occur.

The flow-out start temperature and the softening temperature are measured with an apparatus CFT-500 manufactured by Shimadzu Seisakusho in the following procedure.

At first, about 1 gram of a polyester resin and a toner for electrophotography were weighed, and set on a die (a diameter is 1 mm and a thickness 10 mm). Then, after preheating at 50° C. for 300 seconds under a cylinder pressure of 20 kgf/cm$^2$, the temperature was elevated at a rate of 6.0° C. per minute. The temperature at which the toner starts to flow is defined as the flow-out start temperature ($T_{fb}$). The temperature, which is half the yield temperature is calculated as $T_{1/2}$.

When the softening temperature ($T_{1/2}$) measured by a flow tester for an electrophotographic toner is within a range of 110 to 140° C., the offset was prevented without coating a lot of silicone oil after fixing the image. Further, a high fixing strength was secured. If the softening temperature ($T_{1/2}$) of the toner is lower than 110° C., the offset happens frequently, and if the softening temperature is higher than 140° C., the fixability decreases.

The electrophotographic toner of the present invention contains carnauba wax as a release agent. In the conventional toners, polypropylene wax, polyethylene wax, Fischcer-Tropsch wax, etc have been used widely as a release agent. However, when these waxes are combined with polyester resins, dispersibility of the waxes is not good and image concentration and deterioration of images tend to occur as the printing goes on. On the other hand, the carnauba wax has good dispersibility in polyester resins and has good releasing property and friction property.

The release agents are used singly or combinations thereof. In any case, an amount of the release agent is preferably within a range of 0.1 to 8 parts by weight per 100 parts by weight of the polyester resins, more preferably within a range of 1 to 4 parts by weight. As a result, it is possible to obtain anti-offset property, high fixing strength and friction test strength. If an amount of the release agent is less than 0.1 part by weight per 100 parts by weight of the polyester resins, offset tends to occur, and if the amount is larger than 8 parts by weight, carrier spent tends to occur and quality of image becomes worse.

In the electrophotographic toner of the present invention, a charge control agent is a boron complex of salicylic acid derivative. Metal complexes of salicylic acid derivatives are well known as a negative charge control agent, and chromium and zinc are employed as the center metal of the complexes. When the metal complexes of salicylic acid derivatives are used as the charge control agent, stable charge amount is obtained easily. However, the salicylic acid derivatives whose center metals are chromium have a fear that it gives affects on environment. When the salicylic acid derivatives whose center metals are zinc have a problem that the zinc complexes are water soluble strong toxic substances. Therefore, charge control agents different from the metal complexes are desired in view of safety.

Boron complexes of salicylic acid derivatives are disclosed in Japanese patent laid-open Hei2-486874 and Japanese patent laid-open hei7-13765. An example of the complexes is borobispotassium (1,1 -diphenyl-1 -oxyo-acetyl) is disclosed in the patent documents. Since water soluble components of the boron complexes of salicylic acid derivatives are not toxic, they are safe charge control agents.

An electrophotographic toner was prepared using the boron complexes. A two-components developing agent was prepared using the toner and image forming was conducted. As a result, When printing immediately after the stop of printing was done, an deposit amount of the toner on paper increased and color tone change was observed. This phenomenon shows that the boron complexes of salicylic acid derivatives do not positively increase a quantity of charge of the electrophotographic toner; on the contrary, the complexes have an effect to suppress the quantity of charge.

Since the color toner does not contain a black electroconductive material such as magnetic material or carbon black, there is a tendency that the quantity of charge becomes high because the toner does not leak the charge. Although this tendency appears remarkably when polyester resins that have a high negative charging property, it was predicted that the boron complexes of salicylic acid derivatives may have an effect as a charge control agent.

When the boron complexes of salicylic acid derivatives are used as a charge control agent, a toner concentration increased immediately after stop of printing, and a quantity of charge decreases to increase an amount of deposit of the toner. The cause of the above phenomena was investigated.

As a result, it was confirmed that when an amount of the boron complexes exceeds 1 part by weight per 100 parts by weight of the polyester resins, an increase in the toner concentration and decrease in the quantity of charge immediately after stop of printing took place and that an amount of deposited toner increased. Though the reason of this phenomenon is not clear, it is presumed that the decrease in the quantity of charge was caused by the large amount of boron complexes.

As having been explained, smaller the amount of the boron complexes, higher the quantity of charge is obtained. However, if the amount of boron complexes is less than 0.1 part by weight per 100 parts by weight of the polyester resins, it is impossible to control the quantity of charge thereby to increase the quantity of charge. On the other hand, if the amount of the boron complexes is larger than 1 part by weight per 100 parts by weight of the polyester resins, the effect of suppressing the charge is too large so that an increase in the deposited amount of toner takes place in printing immediately after the stop of printing. Accordingly, when the boron complexes of salicylic acid derivatives are used as the charge control agent, it is preferable to add the complexes in a mount of 0.1 to 1 part by weight.

The quantity of charge of the two component toner can be controlled by a combination method of the electrophotographic toner and the magnetic carrier. When the charge control agent of the boron complexes of salicylic acid derivatives is in an amount of 0.1 to 1 part by weight per 100 parts by weight of the polyester resins, the quantity of charge tends to increase as printing proceeds. The smaller the amount of the charge control agent, the more remarkable this tendency will become. This is caused by appearance of chargeability due to other components such as resins, waxes, etc. Particularly, in the electrophotography using the polyester resins, there is a tendency that a negative charging is strong. If the chargeability increases as the printing proceeds, an amount of deposition of toner on paper becomes small so that the image concentration decreases. As a result, the image concentration decreases as the printing goes on and the printing becomes not practical.

As a countermeasure, resin coating of magnetic carrier eliminates this problem. Controls and adjustment of kinds of resins, compositions, thickness of coating, etc may optimize the coating.

As magnetic carriers, known magnetic carriers can be used. For example, iron powder, ferrite, magnetite, resin carriers wherein magnetic powder particles are dispersed in a binder resin. The magnetic carrier may be coated with a resin. As binder resins for the resin carriers, there are thermoplastic resin such as vinyl resins, polyester resins, nylon resins, polyolefin resins, etc or thermosetting resins such as phenol resins.

As the magnetic powder fine particles, there are magnetoplumbite type ferrite, particles of iron or its alloy which are covered with an oxide layer. The plumbite type ferrite includes spinel ferrite such as magnetite, gamma iron oxide, etc, spinel ferrite containing metals such as Mn, Ni, Zn, Mg, Cu, etc, or barium ferrite.

The shape of the fine particles of the magnetic powder may be granular, spherical, needle like, etc. In case where a high magnetization is required, ferromagnetic fine particles of iron are preferable. In considering the chemical stability of the fine particles, preferable materials are spinels containing magnetite and gamma iron oxide or magnetoplumbite type ferrite such as barium ferrite.

Selection of kinds and concentrations of the ferromagnetic fine particles in the resin carriers makes a resin carrier of desired magnetization property. Magnetization intensity of 30 to 150 emu/g at 100 oersted is preferable for the resin carriers.

The resin carriers can be manufactured by spraying with a dryer a melted mixture of the magnetic fine particles and the insulating binder, for example. Further, they are manufactured by dispersing the magnetic fine particle in the polycondensation type binder wherein a monomer or a prepolymer of the polycondensation type binder is reacted in an aqueous medium in the presence of the magnetic fine particles to cure the binder.

Fine particles of positive or negative charging or a electric conductive particles are sticked on the surface of the carrier. Further, chargeability may be controlled by coating the carrier with a resin.

As coating materials for the magnetic carriers, silicone resins, acrylate resins, epoxy resins, fluorine resins, etc may be used. Further, the carriers may be coated with resin materials containing the positive or negative charge fine particles or the electric conductive fine particles; in this case, silicone resins and acrylate resins are preferable.

A mixing rate of the toner and the magnetic carrier is 2 to 10% by weight as a toner concentration, which is calculated by a weight of the toner/weight of the toner+the carrier)×100 (%).It is preferable to select the friction charge quantity of the two component developer to be −10 to −25 μc/g.

The friction charge quantity was a value measured by a blow off charge quantity measurement device of TB-203 manufactured by Toshiba Chemical Co. under conditions of aspiration pressure of −0.35 Kpa, a blow pressure of 10 KPa and a measurement time of 3 seconds. The weight difference between before and after the measurements is a weight of toner that was peeled off from the developing agent, which is a charge quantity of the toner per 1 g of the toner.

Since the measurement of the friction charge quantity is easily affected by temperature and humidity, measurement should be conducted under the same conditions. The above data is obtained under normal temperature and normal pressure (20-22° C., 50 to 60% RH). The toner charge quantity was based on the measuring method implemented by the Imaging Society of Japan on Dec. 1, 1998.

If the friction charge quantity of the electrophotographic toner is less than −10 μc/g, an amount of toner sticked on paper increases, fog tend to occur. If the image forming apparatus is operated in an atmosphere under a high temperature and high humidity, the friction charge quantity of the toner further decreases so that an amount of the toner sticked on paper and fog further tend to occur. On the other hand, if the friction charge quantity is higher than −25 μc/g, an amount of the toner on paper is too little and an increase in charge quantity under a low humidity atmosphere thereby to lessen the amount of the toner on paper.

In color image forming apparatuses, amounts of consumed toner greatly differ depending on printing patterns. In the case of graphics whose printing density is high, a large amount of the toner is spent, and hence the compensated toner in the two component toner should be charged as quickly as possible. If the rise of the charge quantity is slow, the difference in the charge quantities leads to concentration irregularity on the images. Particularly, in the case of high speed image forming apparatuses at 50 printing pages per minute, since the compensated toner is immediately supplied on the magnet role in the developing area, the countermeasures to the above problems are important.

If a stirring mechanism is disposed in the image forming apparatus so as to supply the toner that is sufficiently supplied on the magnet role after it is sufficiently friction charged, the rise of the charge of the toner supplied on the magnet role can be made quickly. However, the time from the compensation of the toner to supply of the charged toner on the magnet role will be long. Since the toner is not supplied during the stirring of the toner, a decrease in the image concentration due to lowering of the toner concentration caused by spending of the toner in the two-components toner may occur. Further, since the toner is imparted by a mechanical stress by stirring, the life of the two-components toner may be shortened. Accordingly, the improvement of the toner itself is necessary to fasten the rise of the charge quantity.

In printing of a high printing density, a method for fastening the rise of charge quantity without concentration irregularity was investigated. As a result, it has been revealed that adhesion of fine silica particles especially primary particles of 10 nm or less on the toner particles was effective. The adhesion of the primary particles of silica of 10 nm or less is effective to suppress the change of image concentration immediately after nighttime or after the stop of printing.

From the above explanation, in the electrophotographic toner of the present invention, it is preferable that the toner should contain 0.1 to 1 part by weight of boron complexes of salicylic acid derivatives per 100 parts by weight of the polyester resins as the charge control agent and that it should contain the primary silica particles of 10 nm or less.

The above-described primary silica fine powder having a specific surface area of 200 $m^2/g$ or more, which is measured by a BET method using nitrogen adsorption is preferable. Further, An amount of the silica fine powder is preferably 0.01 to 5 parts by weight per 100 parts by weight of the electrophotographic toner. Particularly, an amount of the silica fine powder is more preferably 0.3 parts by weight or more so that a quick rise of the charge quantity and prevention of concentration irregularity are achieved. The silica fine powder can be used after processing with organic silicone agents or various processing agents to make it hydrophobic or to control charging capability of the silica fine powder. Since the fluidity, durability, storage property, etc of the silica fine powder may change depending on kinds and amounts of processing agents and a particle size of the silica fine powder, the materials and conditions are selected in accordance with purposes.

The electrophotographic toner of the present invention may contain a slip additive powder such as polytetrafluoroethylene powder, zinc stearate powder, polyfluroride vinylidene powder, etc. Fluidity assisting agents such as titanium oxide powder, aluminum oxide, etc and coagulation preventing agents may be added to the toner. Electro-conductive assisting agents such as carbon black powder, zinc oxide powder, antimony oxide powder; tin oxide powder etc may be added. White fine powder or black fine powder with reverse polarity may also be added.

The electrophotographic toner of the present invention may contain other magnetic materials. The magnetic materials may have a function to a coloring agent. Usable magnetic materials are magnetite, hematite, ferrite, etc. Metals such as iron, cobalt, nickel or their alloys or mixtures with aluminum, copper, lead, magnesium, tin, zinc, antimony, calcium, manganese, selenium, tungsten, vanadium, etc may be added to the toner.

The additive magnetic materials should have a particle size of 2 μm or less; particularly, 0.1 to 0.5 μm is preferable. An additive amount is preferably 0.1 to 200% by weight based on the weight of the fixing resin.

In the toner according to the present invention, as coloring agents any pigments or dyes are used. Examples of the pigments are carbon black, aniline black, acetylene black, naphthol yellow, hansa yellow, rohdamine lake, alizarine lake, iron oxide red, phthalocianine blue, indanthrene blue, quinacridone, naphthol red, benzimidazorone, etc; the coloring agents are not limited the above. These coloring agents are used in a amount sufficient to keep the optical concentration and color tone of fixed images; preferably 0.2 to 15% by weight based on the resin.

Examples of dyes are azo dyes, anthraquinone dyes, xanthene dyes, methane dyes, etc. These dyes are added in an amount of 0.2 to 15% by weight based on the resin.

Although the particle size of the toner may be measured by different methods, the particle size is represented by data measured by a COULTER COUNTER TA-II, manufactured by Coulter Electronics Inc., wherein an aperture size was 100 μm. The distribution of particles and volume distribution were measured. A measurement sample was prepared in such a manner that a toner to be measured was dispersed by an ultrasonic stirrer in an electrolyte solution containing a surfactant. 50,000 Particles were measured.

The average particle size is preferably 4 to 10 μm; further, it is preferable to control an amount of particles to be 15% or less (the number of particles). If the number of particles of 4 μm is 10% or less, the durability of the toner is extended. In the two-components toner, the carrier and several % of the toner are mixed, and the toner is charged by friction of the carrier and the toner. Upon friction of the components, a carrier of a particle size of 4 μm or less are hard to separate from the toner, and spent appears in the surface of the toner because the carrier and the toner are in contact for a long time. Further, the fine toner particles of 4 μm or less needs a larger energy than the larger toner particles in adhesion on non-printing (fog) area of the paper and fixing. Therefore, this is not useful for low temperature fixing.

A rate of the number of the fine toner particles of 4 μm or less is preferably 15% or less based on the total toner particles. More preferably, the rate is 10% or less, and most preferably 8% or less.

The electrophotographic toner of the present invention can be prepared by mixing the fixing resin, the charge control agent, the coloring agent, the magnetic powder, and additives if necessary, kneading under melted state, cooling to solidify the melted composition, fine grinding the cooled composition and sheaving the resulting powder. A mixer such as a HENSCHEL MIXER, a SUPER MIXER, etc can be used. As a kneader, a heat melting kneader such as a heat role, kneader and an extruder can be used. As the fine grinding method, a jet mill method is employed wherein toner particles are included in a high speed gas stream and the toner particles are collided against a collision plate with a high energy thereby to finely grind the toner particles. A particles collision method wherein particles are collided against each other in gas stream or a mechanical fine grinding method wherein toner particles are supplied between a gap and a rotor rotating at a high speed.

Since the toner particles are ground by collision energy in the jet mill method and the particles collision method, the shape of ground particles is relatively sharp. On the other hand, in the case of mechanical grinding methods, the ground particles tend to be spherical because particles are rubbed between gaps and the surface of the particles are made spherical by friction heat. In the fine particle toners and low temperature fixing toners, the mechanical grinding methods are preferable. According to the mechanical grinding methods, it is possible to avoid such a phenomenon as the collided melted particles adhere to the collision plate, which is disclosed in Japanese Patent Laid-open 07-287413. Further, in fine particle toners and wax containing toners, decrease in fluidity of the toner is avoided.

The toner according to the present invention can be prepared by so-called a polymerization method wherein polymerization of monomers is carried out in the presence of a coloring agent, a charge control agent, wax, etc. The toner can be prepared by a micro capsule method. The prepared toner is admixed with desired additives by a HENSCHEL MIXER.

In the following, an image forming apparatus is explained. In the image forming apparatus, a developing device is chosen in accordance with a transfer speed of an electrostatic charge holding member. In high speed printers wherein the transfer speed of the electrostatic charge holding member is high, it is widely employed that plural developing magnet roles are used to enlarge a developing area thereby to extend a developing time, because one magnet role is insufficient for development.

In case where the plural magnet roles are used, a higher resolution is expected than in the case of the single magnet role. As a result, printing of wide area images becomes possible; improvement of printing quality and reduction of the amount of toner in the developing agent are realized. The rotating speed of the developing roles can be lowered so that scattering of toner and carrier spent by the toner can be prevented by lowering a load on the developing agent thereby to extend the life of the two component developing agent.

However, in a unidirectional developing system where the developing role rotates in the same direction of the traveling direction of the electrostatic charge holding member, there are problems that fogs of the background tend to occur, peripheries of images tend to be lost, and brush trails tend to remain.

On the other hand, in a reverse direction developing system where the developing role rotates in the backward direction with respect to the traveling direction of the electrostatic charge holding member, there is a little fog of the background, and the brush trails are hard to occur, though the peripheries of images may be lost. The backward direction developing system has low developing performance because an effective amount of toner that is in contact with the electrostatic charge holding member is little.

The center feed system which is provided with a developing role, which rotates in the forward direction of the traveling direction of the electrostatic charge holding member and a role, which rotates in the backward direction of the retention member has many advantages over other systems. The developing apparatus of center feed system is disclosed in Japanese Patent Publication 62-46662, for example.

When the center feed system is combined with the toner of the present invention, many advantages over the conventional developing devices would be brought about. For example, printed images are excellent, and desired image concentrations are maintained even when printing is started immediately after nighttime or holidays where the printing apparatus does not work. It is also possible to provide the image forming apparatus that has little change of image concentration with respect to the change of printing density.

An example of the center feed system type image forming apparatus is shown in FIG. 1. In FIG. 1, the surface of the drum shape photosensitive member 1 which is an electrostatic charge holding member is homogeneously charged with a charging device 2, and an electrostatic latent image is formed on the photosensitive member 1 with an optical device 8. The electrostatic latent image is developed as a visible toner image on the photosensitive member 1 by the developing device 3. The developing device 3 is the center feed system, which is provided with a first developing role 11 rotating in the reverse direction of the photosensitive drum 1 and a second developing role 12 rotating in the forward direction with respect to the drum. The image forming apparatus 3 is, in addition to the developing roles, further provided with the two component developing agent 13 comprising toner 9 and carrier 10, a stirring member 14, a restriction member 15, etc. In FIG. 1, the number of reverse rotation role 11 and the forward rotation role 12 may be selected to be one or more in accordance with purposes.

The toner images of the photosensitive member 1 are transferred to recording medium 4 by a transfer device 5. Residual toner on the photosensitive member 1 is removed with a cleaning device 7.

The transferred images on the recording medium are then fixed by a fixing device 6 to obtain desired recording images. According to the image forming apparatus of the present invention, a stable image concentration can be maintained even immediately after the stop of the apparatus and there is little change of the image concentration with respect to the change of printing density.

The toner of the present invention exhibits good fixing performance, fluidity, heat-resistance, durability and storage stability; a decrease in life of the toner due to the carrier spent caused by toner particles and shortening of the photosensitive member caused by filming of the toner are hard to occur. Further, offset phenomenon hardly occurs.

In the following, examples of the present invention will be explained. The examples do not limit the scope of the present invention.

EXAMPLE 1

(i) Preparation of Electrophotographic Toner

A toner was prepared using a polyester resin (1) and a polyester resin (2) as a fixing resin.

The polyester resin (1) has a flow starting temperature ($T_{fb}$) of 91.0° C., a softening temperature ($T_{1/2}$) of 108.5° C., a Mw (weight average molecular weight) of 7,400, a Mn (number average molecular weight) of 4,950, a Tg (glass transition temperature) of 57.6° C., an acid value of 6.8 mg KOH/g.

The polyester resin (2) has a flow starting temperature ($T_{fb}$) of 117.3° C., a softening temperature ($T_{1/2}$) of 153.9° C., a Mw of 118,900, a Mn of 4,900, a Tg (glass transition temperature) of 56.3° C., an acid value of 3.7 mg KOH/g.

A mixing rate of the polyester (1) to polyester (2) was 30-70:80-20; mixing rates were changed at every 10% to prepare 5 kinds of compositions.

92 Parts by weight of the polyesters, 0.5 part by weight of borobispotassium (1,1 -diphenyl-1 -oxo-acetyl), 4.0 parts by weight of C.I. pigment blue —15:3 and 3.5 parts by weight of carnauba wax (manufactured by Cerarica Noda Co. under the name of Carnauba wax NO1)) were pre-mixed with a super mixer. The mixture was further mixed with a double axis kneader. Then, the mixture was crashed and ground. After grinding, the powder was subjected to sheaving with a dry air stream sheaving machine to obtain a toner mother material of an average particle size of 9μm.

0.4 Part by weight of a hydrophobic silica (manufactured by Japan Aerosil Co. under the name of R976, a primary particle size: 7 nm) and 0.4 part by weight of inorganic particles (manufactured by Japan Aerosil Co. under the name of RX50, a primary particle size; 40 nm) were added to 100 parts by weight of the mother material. The mixture was mixed with a HENECHEL MIXER to adhere the hydrophobic silica powder on the toner thereby to obtain a blue toner.

When the mixing rate of the polyester (1) to the polyester (2) is within a range of from 40.4 to 59.6 to 74.7 to 25.3, the formula (1) is satisfied.

(ii) Preparation of Electrophotographic Toner

A toner was prepared using a polyester resin (3) and a polyester resin (4) as a fixing resin.

The polyester resin (3) has a flow starting temperature ($T_{fb}$) of 83.2° C., a softening temperature ($T_{1/2}$) of 99.1° C., Mw of 5,700, Mn of 2,800, Tg of 53.4° C., an acid value of 8.6 mg KOH/g.

The polyester resin (4) has a flow starting temperature ($T_{fb}$) of 103.3° C., a softening temperature ($T_{1/2}$) of 129.0° C., Mw of 78,000, Mn of 3,400, Tg of 58.4° C., an acid value of 7.1 mg KOH/g.

A mixing rate of the polyester (3) to polyester (4) was 40-60:70-30; mixing rates were changed at every 10%.

91.7 Parts by weight of the polyesters, 0.8 part by weight of borobispotassium (1,1-diphenyl-1-1oxo-acetyl), 4.0 parts by weight of C.I. pigment blue —15:3 and 3.5 parts by weight of carnauba wax (manufactured by Cerarica Noda Co. under the name of Carnauba wax NO1)) were pre-mixed with a super mixer. The mixture was further mixed with a double axis kneader. Then, the blue toner on which hydrophobic silica powder was adhered was prepared in the similar manner as in (i) above.

When the mixing rate of the polyester (1) to the polyester (2) is within a range of from 44.6 to 55.4 to 67.8 to 32.2, the formula (1) is satisfied.

(iii) Preparation of Electrophotographic Toner

A toner was prepared using a polyester resin (3) and a polyester resin (5) as a fixing resin.

The polyester resin (5) has a flow starting temperature ($T_{fb}$) of 120.0° C., a softening temperature ($T_{1/2}$) of 161.3° C., Mw of 125,300, Mn of 5,100, Tg of 57.0° C., an acid value of 4.0 mg KOH/g.

A mixing rate of the polyester (3) to polyester (5) was 30-70:90-10; mixing rates were changed at every 10%.

92 Parts by weight of the polyesters, 0.5 part by weight of borobispotassium (1 ,1-diphenyl-1-1oxo-acetyl), 4.0 parts by weight of C.I. pigment blue −15:3, 1.5 parts by weight of carnauba wax (manufactured by Cerarica Noda Co. under the name of Carnauba wax NO1)) and 2 parts by weight of rice wax (manufactured by Cerarica Noda Co. Ltd. under the name of Rice Wax M-90) were pre-mixed with a super mixer. Then, the blue toner on which hydrophobic silica powder was adhered was prepared in the similar manner as in (i) above.

When the mixing rate of the polyester (1) to the polyester (2) is within a range of from 38.7 to 61.3 to 80.7 to 19.3, the formula (1) is satisfied.

Evaluation of Ability to Fix

A two-components developing agent for electrophotography was prepared using the toner and a magnetic carrier of which surface is coated with resin.

An image forming was performed by a laser beam printer of electrophotographic system using an OPC (organic photoconductor) as a photosensitive member. The image forming of 70 pages/min. (a printing process speed; 31.4 cm/sec) was performed under the conditions of a charge potential of OPC of −500 V, a residual potential of −50 V, a developing bias potential of −350 V and a contrast potential at a developing section of 150 V.

As a developing device, the center feed system device was used. The device had the reverse rotating role and the forward rotating role with respect to the traveling direction of the electrostatic charge holding member. A developing gap (a distance between the photosensitive member and the developing role sleeve) was 0.5 mm. The development was performed by a reverse development method.

A fixing device is provided with a heat role whose aluminum core was covered with a sleeve made of a fluorine containing resin, i.e. tetrafluoroethylene-perfluoroalkylvinylether copolymer (PFA) with a thickness of 40 μm and a heater lamp disposed in the center of the aluminum core. The aluminum core was covered with a silicone rubber having a hardness of about 30 degrees and an outermost layer of the PFA was formed on the silicone rubber layer to make a backup role.

The fixing conditions were: a process speed 31.4 cm/sec, an-outer diameter of the heat role and the backup role 60 mm, a pressing down load 60 kgf, and a contact area between the roles (nip) about 7 mm. Although a cleaner of a NOMEX (trade mark) paper winding type with which silicone oil is impregnated is normally disposed, it is omitted because the experiment was offset evaluation. The hot offset was evaluated after continuous printing of 100 pages of paper (a thickness; about 100 μm) to record images under the condition of oil-less state. Further, the cold offset was confirmed after continuous printing of thick paper (a thickness; about 200 μm) of 100 pages.

A tape peel of f test on the solid printing of one inch square was conducted to evaluate a fixing strength of the image. The tape peel off test was conducted using SCOTCH tape 810 (manufactured by Sumitomo 3M). The tape was adhered on the solid image and image concentrations before and after peel off of the tape were measured. According to the following equation, tape peel off strength was measured. The results are shown in Tables 1 to 3.

Tape peel off strength (%)=a reflection concentration of solid black image after peel off of the tape/a reflection concentration of solid black image before peel off of the tape x100 equation. (2)

The results using the polyester (1) and the polyester (2) are shown. Compositions which do not satisfy the equation (1) are shown as comparative examples. As is apparent from Table 1, the toner using the compositions of examples 1 to 3 exhibited no offset. The toners did not occur hot offset, and cold offset, either.

Further, the toners maintained the tape peel off strength of 70% or more so that a sufficient ability to fix was obtained. On the other hand, the toner of comparative example 1 exhibited cold offset, the toner of comparative example 2 exhibited a low tape peel off strength and poor ability to fix, and the toner of comparative example 3 exhibited hot offset while it had a high tape peel off strength.

In the data shown in Table 2, the polyester (3) and the polyester (4) were employed. In the comparative examples 4 and 5, lowering of the tape peel off strength and hot offset were observed.

Table 3 shows toners using the polyester (3) and the polyester (5). In the comparative examples 6 and 7, a low fixing ability and hot offset were observed. In examples 6 to 10, no offset was observed and a tape peel off strength of 70% or more was obtained.

Printing test was carried out using the toners of examples 1 to 10 and the laser beam printer used in the fixing test. The cleaner was installed to the laser beam printer. The toners did not show shortening of life of the developing agents due to carrier spent and shortening of life of the photosensitive ember due to filming of the toner after printing of 100 thousand pages, and did show stable printing performance. Even there is printing density, the printing articles did not show a large change of image concentration after the stop of printing.

TABLE 1

| | Polyester (1) | Polyester (2) | Within the range of equation (1) | Hot offset | Cold offset | Tape peel off strength (%) | Toner softening temp. (° C.) |
|---|---|---|---|---|---|---|---|
| Comp. Ex. 1 | 30 | 70 | X | No | Yes | 34.2 | 141.3 |
| Comp. Ex. 2 | 40 | 60 | X | No | No | 51.3 | 135.7 |
| Ex. 1 | 50 | 50 | ○ | No | No | 75.2 | 130.8 |
| Ex. 2 | 60 | 40 | ○ | No | No | 84.6 | 127.2 |
| Ex. 3 | 70 | 30 | ○ | No | No | 86.7 | 123.1 |
| Comp. Ex. 3 | 80 | 20 | X | Yes | No | 90.1 | 118.5 |

TABLE 2

| | Polyester (3) | Polyester (4) | Within the range of equation (1) | Hot offset | Cold offset | Tape peel off strength (%) | Toner softening temp. (° C.) |
|---|---|---|---|---|---|---|---|
| Comp. Ex. 4 | 40 | 60 | X | No | No | 40.8 | 117.5 |
| Ex. 4 | 50 | 50 | ○ | No | No | 70.8 | 114.2 |
| Ex. 5 | 60 | 40 | ○ | No | No | 78.5 | 11.6 |
| Comp. Ex. 5 | 70 | 30 | X | Yes | No | 87.8 | 108.3 |

TABLE 3

| | Polyester (3) | Polyester (5) | Within the range of equation (1) | Hot offset | Cold offset | Tape peel off strength (%) | Toner softening temp. (° C.) |
|---|---|---|---|---|---|---|---|
| Com. Ex. 6 | 30 | 70 | X | No | No | 54.3 | 141.5 |
| Ex. 6 | 40 | 60 | ○ | No | No | 74.8 | 135.2 |
| Ex. 7 | 50 | 50 | ○ | No | No | 81.9 | 129.0 |
| Ex. 8 | 60 | 40 | ○ | No | No | 88.4 | 123.2 |
| Ex. 9 | 70 | 30 | ○ | No | No | 92.7 | 117.5 |
| Ex. 10 | 80 | 20 | ○ | No | No | 95.3 | 111.8 |
| Comp. Ex. 7 | 90 | 10 | X | Yes | No | 98.2 | 105.8 |

What is claimed is:

1. An electrophotographic toner comprising at least a fixing resin, a coloring agent, a release agent and a charge control agent, wherein the release agent is carnauba wax, the charge control agent is a boron complex of a salicylic acid derivative, and the fixing resin contains two different polyester resins producing a ratio represented by the following equation (1);

$$\frac{A(T_{1/2})-A(T_{fb})}{B(T_{1/2})-B(T_{fb})} \leqq \frac{A(T_{1/2})\times C}{B(T_{1/2})\times D} \leqq \frac{B(T_{1/2})-B(T_{fb})}{A(T_{1/2})-A(T_{fb})}, \quad (1)$$

wherein in the above equation, $A(T_{1/2})-A(T_{fb})<B(T_{1/2})-B(T_{fb})$, $A(T_{1/2})$ represents a softening point (° C.) of the polyester A, $A(T_{fb})$ a flow-out start point (° C.) of the polyester A, $B(T_{1/2})$ a softening point (° C.) of the polyester B, $B(T_{fb})$ a flow-out start point (° C.) of the polyester B, C a weight rate of the polyester A in the fixing resin, and D a weight rate of the polyester B in the fixing resin;

wherein the electrostatic quantity of the electrophotographic toner by friction charging is within a range of −10 to −25 μc/g.

2. The electrophotographic toner according to claim 1, wherein an amount of the boron complex of the salicylic acid derivative is 0.1 to 1 parts by weight per 100 parts by weight of the fixing resin.

3. The electrophotographic toner according to claim 1, wherein the surface of the toner has fine silica particles of the primary particle having a size of 10 nm or less.

4. The electrophotographic toner according to claim 1, wherein the softening point ($T_{1/2}$) of the toner is within a range of 110 to 140° C.

5. The electrophotographic toner according to claim 1, wherein the electrophotographic toner is an electrophotographic color toner.

6. An image forming apparatus comprising an electrostatic charger which charges a surface of an electrophotographic photosensitive member, an optical device which exposes the electrophotographic photosensitive member thereby to form an electrostatic latent image on the electrophotographic photosensitive member, a developing device containing a developing toner and which supplies the developing toner to the latent image thereby to form a toner image on the electrophotographic photosensitive member, a transfer unit which transfers the toner image to a recording medium, and a fixing unit which fixes the transferred toner image on the recording medium, wherein the electrostatic latent image formed on the electrophotographic photosensitive member is developed as the toner image by the developing toner, the developed toner image is transferred on the recording medium, and the transferred toner image is fixed on the recording medium to obtain a recording image, the developing toner being an electrophotographic toner comprising at least a fixing resin, a coloring agent, a release agent and a charge control agent, wherein the release agent is carnauba wax, the charge control agent is a boron complex of a salicylic acid derivative, and the fixing resin contains two different polyester resins producing a ratio represented by the following equation (1);

$$\frac{A(T_{1/2})-A(T_{fb})}{B(T_{1/2})-B(T_{fb})} \leqq \frac{A(T_{1/2})\times C}{B(T_{1/2})\times D} \leqq \frac{B(T_{1/2})-B(T_{fb})}{A(T_{1/2})-A(T_{fb})}, \quad (1)$$

wherein in the above equation, $A(T_{1/2})-A(T_{fb})<B(T_{1/2})-B(T_{fb})$, $A(T_{1/2})$ represents a softening point (° C.) of the polyester A, $A(T_{fb})$ a flow-out start point (° C.) of the polyester A, $B(T_{1/2})$ a softening point (° C.) of the polyester B, $B(T_{fb})$ a flow-out start point (° C.) of the polyester B, C a weight rate of the polyester A in the fixing resin, and D a weight rate of the polyester B in the fixing resin; and wherein the electrostatic quantity of the electrophotographic toner by friction charging is within a range of −10 to −25 μc/g.

7. The image forming apparatus according to claim 6, wherein an amount of the boron complex of the salicylic acid derivative is 0.1 to 1 parts by weight per 100 parts by weight of the fixing resin.

8. The image forming apparatus according to claim 6, wherein the softening point (T1/2) of the toner is within a range of 110 to 140° C.

9. The image forming apparatus according to claim 6, wherein the electrophotographic toner is an electrophotographic color toner.

* * * * *